US009050656B2

(12) United States Patent
Glass et al.

(10) Patent No.: US 9,050,656 B2
(45) Date of Patent: Jun. 9, 2015

(54) CASTING OF TUNGSTEN CARBIDE MATRIX BIT HEADS AND HEATING BIT HEAD PORTIONS WITH MICROWAVE RADIATION

(75) Inventors: Kevin L. Glass, Spring, TX (US); Durell M. Ashby, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 714 days.

(21) Appl. No.: 12/523,316

(22) PCT Filed: Jan. 18, 2008

(86) PCT No.: PCT/US2008/051427
§ 371 (c)(1),
(2), (4) Date: Jul. 15, 2009

(87) PCT Pub. No.: WO2008/091793

PCT Pub. Date: Jul. 31, 2008

(65) Prior Publication Data

US 2010/0278604 A1 Nov. 4, 2010

Related U.S. Application Data

(60) Provisional application No. 60/885,511, filed on Jan. 18, 2007.

(51) Int. Cl.
*B22F 3/26* (2006.01)
*C22C 29/06* (2006.01)
(Continued)

(52) U.S. Cl.
CPC ..... *B22F 3/26* (2013.01); *Y10T 408/89* (2015.01); *B22F 2005/001* (2013.01);
(Continued)

(58) Field of Classification Search
CPC .... B22F 2999/00; B22F 3/26; B22F 2202/05; B22F 2202/11; B22F 2005/001; C22C 29/06
USPC ..... 51/293, 295
See application file for complete search history.

(56) References Cited

U.S. PATENT DOCUMENTS 5,119,892 A 6/1992 Clegg et al. ..... 175/431
5,373,907 A 12/1994 Weaver ..... 175/426
(Continued)

FOREIGN PATENT DOCUMENTS

JP 10325546 5/1997 ..... F24C 7/02
JP 10325546 A 5/1997 ..... F24C 7/02
(Continued)

OTHER PUBLICATIONS

Combined Search and Examination Report under Sections 17 & 18(3); Application No. GB 1113812.0; pp. 5, Sep. 19, 2011.
(Continued)

*Primary Examiner* — Shuangyi Abu Ali
(74) *Attorney, Agent, or Firm* — Baker Botts L.L.P.

(57) ABSTRACT

A method of making a drill bit having the following steps: placing matrix material in a bit body mold; placing a metal blank in the bit body mold; placing a binder material in the bit body mold with the binder material proximate the matrix material and the metal blank; and exposing binder material to microwave radiation, whereby binder material and other constituents is heated to a selected temperature to allow binder material to melt and to infiltrate matrix material. A method of heating selected portions of a drill bit comprising: placing the drill bit in an insulative oven having a wave guide of microwave radiation from a microwave generator; positioning a portion of the drill bit to be heated proximate the wave guide; and exposing the portion of the drill bit to be heated to microwave radiation, wherein the portion of the drill bit is heated without overheating remaining portions of the drill bit.

22 Claims, 9 Drawing Sheets

(51) Int. Cl.

| | |
|---|---|
| ***B22D 19/06*** | (2006.01) |
| ***B22D 19/14*** | (2006.01) |
| ***B22D 23/06*** | (2006.01) |
| *B22F 5/00* | (2006.01) |

(52) U.S. Cl.

CPC ..... *B22F 2999/00* (2013.01); *C22C 29/06* (2013.01); *B22D 19/06* (2013.01); *B22D 19/14* (2013.01); *B22D 23/06* (2013.01)

(56) References Cited

U.S. PATENT DOCUMENTS

| | | | | |
|---|---|---|---|---|
| 5,678,644 | A | 10/1997 | Fielder | 175/391 |
| 5,950,747 | A | 9/1999 | Tibbitts et al. | 175/432 |
| 6,063,333 | A * | 5/2000 | Dennis | 419/6 |
| 6,209,420 | B1 * | 4/2001 | Butcher et al. | 76/108.2 |
| 6,296,069 | B1 | 10/2001 | Lamine et al. | 175/434 |
| 6,302,224 | B1 | 10/2001 | Sherwood, Jr. | 175/397 |
| 2004/0011159 | A1 | 1/2004 | Meiners et al. | 76/108.2 |
| 2004/0040750 | A1 * | 3/2004 | Griffo et al. | 175/374 |
| 2004/0238794 | A1 | 12/2004 | Karandikar et al. | 252/500 |
| 2006/0213693 | A1 | 9/2006 | Zahradnik et al. | 175/374 |
| 2006/0231293 | A1 * | 10/2006 | Ladi et al. | 175/374 |

FOREIGN PATENT DOCUMENTS

| | | | | |
|---|---|---|---|---|
| JP | 2005330521 | | 5/2004 | B22F 3/10 |
| JP | 2005330521 | A | 5/2004 | |
| SU | 891919 | | 4/1980 | E21C 37/18 |
| SU | 891919 | A1 | 4/1980 | E21C 37/18 |
| WO | 2008/091793 | | 7/2008 | B28B 19/00 |

OTHER PUBLICATIONS

International Preliminary Report on Patentability; International Application No. PCT/US08/51427; pp. 21, Feb. 23, 2010.

Examination Report, Application No. GB0913945.2, 4 pages, Feb. 23, 2011.

Office Action of the Canadian Intellectual Property Office; Application No. 2,674,393; pp. 3, Sep. 23, 2014.

Office Action of the Canadian Intellectual Property Office; Application No. 2,674,393; pp. 3, Nov. 21, 2013.

* cited by examiner

CASTING OF TUNGSTEN CARBIDE MATRIX BIT HEADS AND HEATING BIT HEAD PORTIONS WITH MICROWAVE RADIATION

CROSS REFERENCE TO RELATED APPLICATIONS

This application is a U.S. National Stage Application of International Application No. PCT/US2008/051427 filed Jan. 18, 2008, which designates the United States of America, and claims the benefit of U.S. Provisional Application No. 60/885,511, filed Jan. 18, 2007, the contents of which are hereby incorporated by reference in their entirety.

TECHNICAL FIELD

The present invention is related to rotary drill bits and steel bit heads, and more particularly to using microwave radiation to heat molds having matrix drill bits with composite matrix bit bodies and using microwave radiation to preheat steel or matrix fixed cutter bits prior to brazing. The invention also relates to heating portions of drill bit heads with microwave radiation.

BACKGROUND OF THE INVENTION

Rotary drill bits are frequently used to drill oil and gas wells, geothermal wells and water wells. Rotary drill bits may be generally classified as rotary cone or roller cone drill bits. Fixed cutter drilling equipment or drag bits may also be used. Fixed cutter drill bits or drag bits are often formed with a matrix bit body having cutting elements or inserts disposed at select locations of exterior portions of the matrix bit body. Fluid flow passageways are typically formed in the matrix bit body to allow communication of drilling fluids from associated surface drilling equipment through a drill string or drill pipe attached to the matrix bit body. Such fixed cutter drill bits or drag bits may sometimes be referred to as "matrix drill bits."

Matrix drill bits are typically formed by placing loose matrix material (sometimes referred to as "matrix powder") into a mold and infiltrating the matrix material with a binder such as a copper alloy. Infiltration is a process by which melted binder material flows by capillary action through the matrix material. During infiltration, the binder material is melted and the matrix material is not melted. Typically, infiltration may be conducted at temperatures lower than would be required for sintering because sintering requires that the matrix material also be at least nearly melted. Thus, because the melting temperature of binder material is lower than the melting temperature of matrix material, infiltration may be performed at a relatively lower temperature than sintering.

In some prior art drill bits, one or more components of a bit body (e.g., bits, teeth, cutters, and inserts) have been formed and/or joined by sintering, requiring very high temperature and very high pressure. For example, the term "cemented carbide" is often used to refer to a material made by cementing tungsten monocarbide (WC) grains in a binder matrix of cobalt metal by liquid phase sintering. Sintering may require expensive and large equipment. In addition, the high temperatures required may induce chemical changes and/or physical changes in the materials used to form the components.

A process called "hot pressing" has also been used form and/or join components, wherein the components are subjected to high pressure and a relatively lower temperature than required for sintering at atmospheric pressure. Because the component is subjected to high pressure, it may be formed at a relatively lower temperature.

Infiltration molds may be formed by milling a block of material such as graphite to define a mold cavity with features that correspond generally with desired exterior features of the resulting matrix drill bit. Various features of the resulting matrix drill bit such as blades, cutter pockets, and/or fluid flow passageways may be provided by shaping the mold cavity and/or by positioning temporary displacement material within interior portions of the mold cavity. A preformed steel shank or bit blank may be placed within the mold cavity to provide reinforcement for the matrix bit body and to allow attachment of the resulting matrix drill bit with a drill string.

In infiltration process, a quantity of matrix material typically in powder form may then be placed within the mold cavity. The matrix material may be infiltrated with a molten metal alloy or binder which will form a matrix bit body after solidification of the binder with the matrix material. Tungsten carbide powder is often used to form conventional matrix bit bodies and copper is used as the binder material.

SUMMARY OF THE DISCLOSURE

In accordance with teachings of the present disclosure, there is provided a method of making a drill bit having the following steps: placing matrix material in a bit body mold; placing a metal blank in the bit body mold; placing a binder material in the bit body mold with the binder material proximate the matrix material and the metal blank; and exposing binder material, including all constituents that make up the binder material, to microwave radiation, whereby binder material is heated to a selected temperature to allow binder material to melt and to infiltrate the matrix material. A flux may also be used on top of the molten binder.

According to another aspect of the invention, there is provided a method of making a drill bit, wherein the method has the following steps: placing at least a first layer of a matrix material selected from the group consisting of cemented carbides, spherical carbides, macrocrystalline tungsten carbide, and cast carbide in a bit body mold; placing a displacement core having a generally cylindrical configuration defined in part by an outside diameter in the bit body mold; placing a metal blank in the bit body mold coaxial with and around the displacement core to form an annulus defined in part by an inside diameter of the metal blank and the outside diameter of the displacement core; placing at least a second layer of a matrix material selected from the group consisting of cemented carbides, spherical carbides, macrocrystalline tungsten carbide, and cast carbide in the bit body mold, wherein the second layer of a matrix material fills the annulus between the displacement core and the metal blank; placing a binder material in the bit body mold with the binder material proximate the matrix material and the metal blank; exposing the binder material to microwave radiation, whereby the binder material is heated to a selected temperature to allow the binder material to melt and to infiltrate the matrix material; and cooling the mold and materials disposed therein to form a coherent matrix bit body securely engaged with the metal blank.

Another aspect of the invention provides a drill bit having a matrix bit body comprising: a unitary blank pin comprising a threaded pin at one end and a casting blank at the opposite end; a matrix bit body comprising a matrix material and a binder material, wherein the binder material is a microwave irradiated material; at least one fluid flow passageway; and at least one pocket.

A further aspect of the invention provides a method of heating selected portions of a drill bit comprising: placing the drill bit in an insulative oven having a wave guide of microwave radiation from a microwave generator; positioning a portion of the drill bit to be heated proximate the wave guide; and exposing the portion of the drill bit to be heated to microwave radiation, wherein the portion of the drill bit is heated without overheating remaining portions of the drill bit.

Another aspect of the invention provides a method of infiltrating matrix material with a binder material, such that the infiltrating process has the following steps: forming matrix material in a mold and placing binder material in the mold adjacent the matrix material; placing the mold in an insulative oven having a wave guide of microwave radiation from a microwave generator; positioning the mold relative to the wave guide for focused heating of material in the mold; and exposing material in the mold to microwave radiation, wherein material in the focus of the microwave radiation is heated without overheating material outside the focus of the microwave radiation, wherein binder material infiltrates matrix material by capillary action.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein:

FIG. 10 is a cross-sectional, side view of a mold assembly and a separate insulative oven for binder material;

FIG. 11 is a cross-sectional, side view of a mold assembly in an insulative oven with two wave guides, wherein the mold assembly is suspended on a hook and a spray nozzle is directed at the mold assembly; and FIG. 12 is a side view of a microwave system for heating a portion of a bit head.

DETAILED DESCRIPTION OF THE DISCLOSURE

Figure 1:
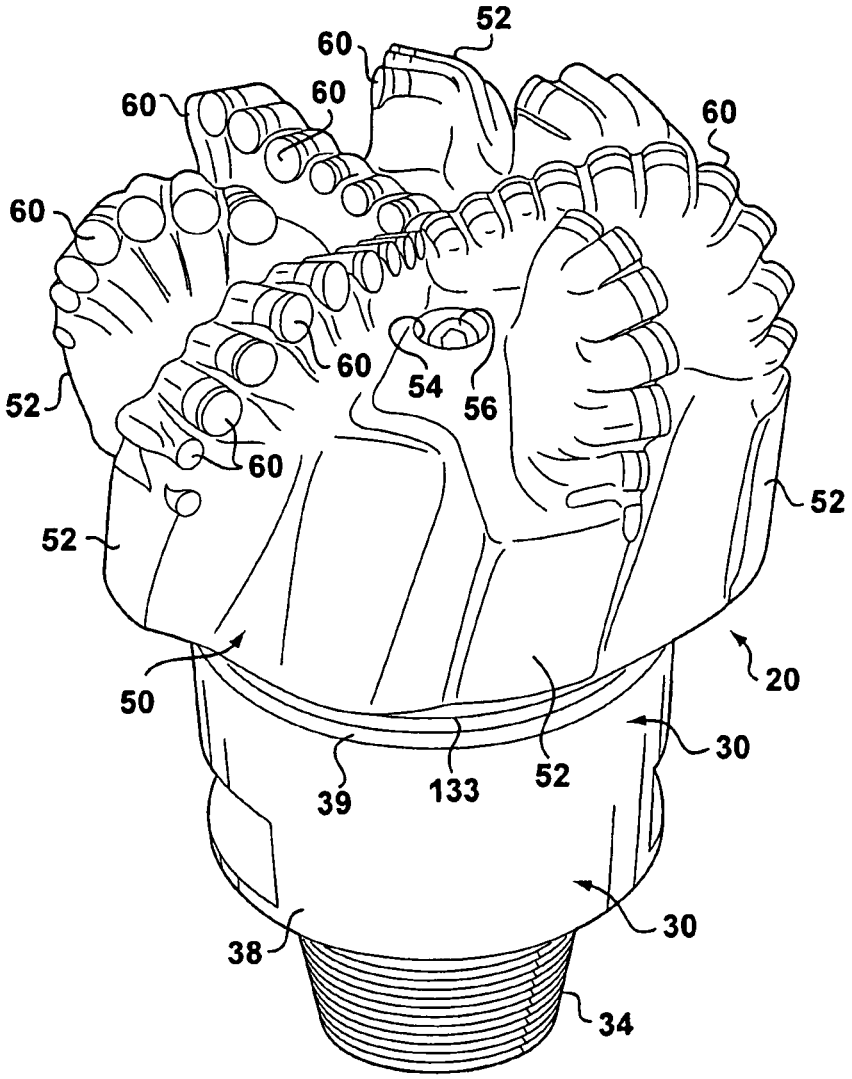
FIG. 1 is a schematic drawing showing an isometric view of a fixed cutter drill bit having a matrix bit body formed in accordance with teachings of the present disclosure.

Preferred embodiments of the disclosure and its advantages are best understood by reference to FIGS. 1-12 wherein like numbers refer to same and like parts.

The terms "matrix drill bit" and "matrix drill bits" may be used in this application to refer to "rotary drag bits", "drag bits", "fixed cutter drill bits" or any other drill bit incorporating teaching of the present disclosure. Such drill bits may be used to form well bores or boreholes in subterranean formations.

Matrix drill bits incorporating teachings of the present disclosure may include a matrix bit body formed in part by a single matrix material or a composite matrix bit body wherein at least two different matrix materials with different performance characteristics may be used to form the bit body. The matrix bit body may be attached to a metal shank. A tool joint having a threaded connection operable to releasably engage the associated matrix drill bit with a drill string, drill pipe, bottom hole assembly or downhole drilling motor may be attached to the metal shank.

One embodiment of a matrix drill bit incorporating teachings of the present disclosure may include a matrix bit body formed in part by infiltration casting of a composite material which incorporates tungsten carbide particles bound together by a copper alloy. This "matrix composite" exhibits both high erosion, abrasion, and wear properties inherent in the tungsten carbide and ductility and toughness inherent in the copper alloy.

Various types of binder materials may be used to infiltrate matrix materials to form a matrix bit body. Binder materials may include, but are not limited to, copper (Cu), nickel (Ni), cobalt (Co), iron (Fe), molybdenum (Mo) individually or alloys based on these metals or any other material satisfactory for use in forming a matrix drill bit. The alloying elements may include, but are not limited to, one or more of the following elements—manganese (Mn), nickel (Ni), tin (Sn), zinc (Zn), silicon (Si), molybdenum (Mo), tungsten (W), boron (B) and phosphorous (P). Such binders generally provide desired ductility, toughness and thermal conductivity for an associated matrix drill bit. Binder materials may cooperate with two or more different types of matrix materials selected in accordance with teachings of the present disclosure to form composite matrix bit bodies with increased toughness and wear properties as compared to many conventional matrix bit bodies.

The terms "cemented carbide" and "cemented carbides" may be used within this application to include WC, MoC, TiC, TaC, NbC, $Cr_3C_2$, VC and solid solutions of mixed carbides such as WC—TiC, WC—TiC—TaC, WC—TiC—(Ta,Nb)C in a metallic binder (matrix) phase. Typically, Co, Ni, Fe, Mo and/or their alloys may be used to form the metallic binder. Cemented carbides may sometimes be referred to as "composite" carbides. Some cemented carbides may also be referred to as spherical carbides. However, cemented carbides may have many configurations and shapes other than spherical.

Cemented carbides may be generally described as powdered refractory carbides which have been united by compression and heat with binder materials such as powdered cobalt, iron, nickel, molybdenum and/or their alloys. Cemented carbides may also be sintered, crushed, screened and/or further processed as appropriate. Cemented carbide pellets may be used to form a matrix bit body. The binder material provides ductility and toughness which often results in greater resistance to fracture (toughness) of cemented carbide pellets, spheres or other configurations as compared to cast carbides, macrocrystalline tungsten carbide and/or formulates thereof.

The binder materials used to form cemented carbides may sometimes be referred to as "bonding materials" in this patent application to help distinguish between binder materials used to form cemented carbides and binder materials used to form a matrix drill bit.

As discussed later in more detail, metallic elements and/or their alloys in bonding materials associated with cemented carbides may "contaminate" hot, liquid (molten) infiltrants such as copper based alloys and other types of binder materials associated with forming matrix drill bits as the molten infiltrant travels through the cemented carbides prior to solidifying to form a desired matrix. This kind of "contamination" (enrichment of infiltrant with bonding material from cemented carbides) of a molten infiltrant may alter the solidus (temperature below which infiltrant is all solid) and liquidus (temperature above which infiltrant is all liquid) of the infiltrant as it travels under the influence of capillary action through the cemented carbide. This phenomena may have an adverse effect on the wettability of the cemented carbides resulting in lack of satisfactory infiltration of the cemented carbides prior to solidifying to form the desired matrix.

Cast carbides may generally be described as having two phases, tungsten monocarbide and ditungsten carbide. Cast carbides often have characteristics such as hardness, wettability and response to contaminated hot, liquid binders which are different from cemented carbides or spherical carbides.

Macrocrystalline tungsten carbide may be generally described as particles (powders) of single crystals of monotungsten carbide with additions of cast carbide, Ni, Fe, Carbonyl of Fe, Ni, etc. Both cemented carbides and macrocrystalline tungsten carbides are generally described as hard materials with high resistance to abrasion, erosion and wear. Macrocrystalline tungsten carbide may also have characteristics such as hardness, wettability and response to contaminated hot, liquid binders which are different from cemented carbides or spherical carbides.

In accordance with teachings of the present disclosure, matrix material may include a mixture of sizes which range from 45 microns to 200 microns. The selection of sizes may range from 45 microns to 200 microns. The selection of sizes may optimize packing density of the particles used. The infiltrate alloy in the "matrix composite" may constitute between 25%-30% by weight of the matrix drill bit. The tungsten carbide particles may be selected from one or more various forms of cemented carbide (e.g., pellets, spheres or other configurations) and/or other types of tungsten carbide (e.g., cast carbides and macrocrystalline tungsten carbide).

FIG. 1 is a schematic drawing showing one example of a matrix drill bit or fixed cutter drill bit formed with a matrix bit body in accordance with teachings of the present disclosure. For embodiments such as shown in FIG. 1, matrix drill bit 20 may include metal shank 30 with matrix bit body 50 securely attached thereto. Metal shank 30 may be described as having a generally hollow, cylindrical configuration defined in part by fluid flow passageway 32 in FIG. 3. Various types of threaded connections, such as American Petroleum Institute (API) connection or threaded pin 34, may be formed on metal shank 30 opposite from composite matrix bit body 50. Threaded connections may be formed by any appropriate process, several of which are known in the art.

For some applications generally cylindrical metal blank or casting blank 36 (See FIGS. 2 and 3) may be attached to hollow, generally cylindrical metal shank 30 using various techniques. For example annular weld groove 38 (See FIG. 3) may be formed between adjacent portions of blank 36 and shank 30. Weld 39 may be formed in groove 38 between blank 36 and shank 30. See FIG. 1. Fluid flow passageway or longitudinal bore 32 preferably extends through metal shank 30 and metal blank 36. Metal blank 36 and metal shank 30 may be formed from various steel alloys or any other metal alloy associated with manufacturing rotary drill bits.

Figure 2:
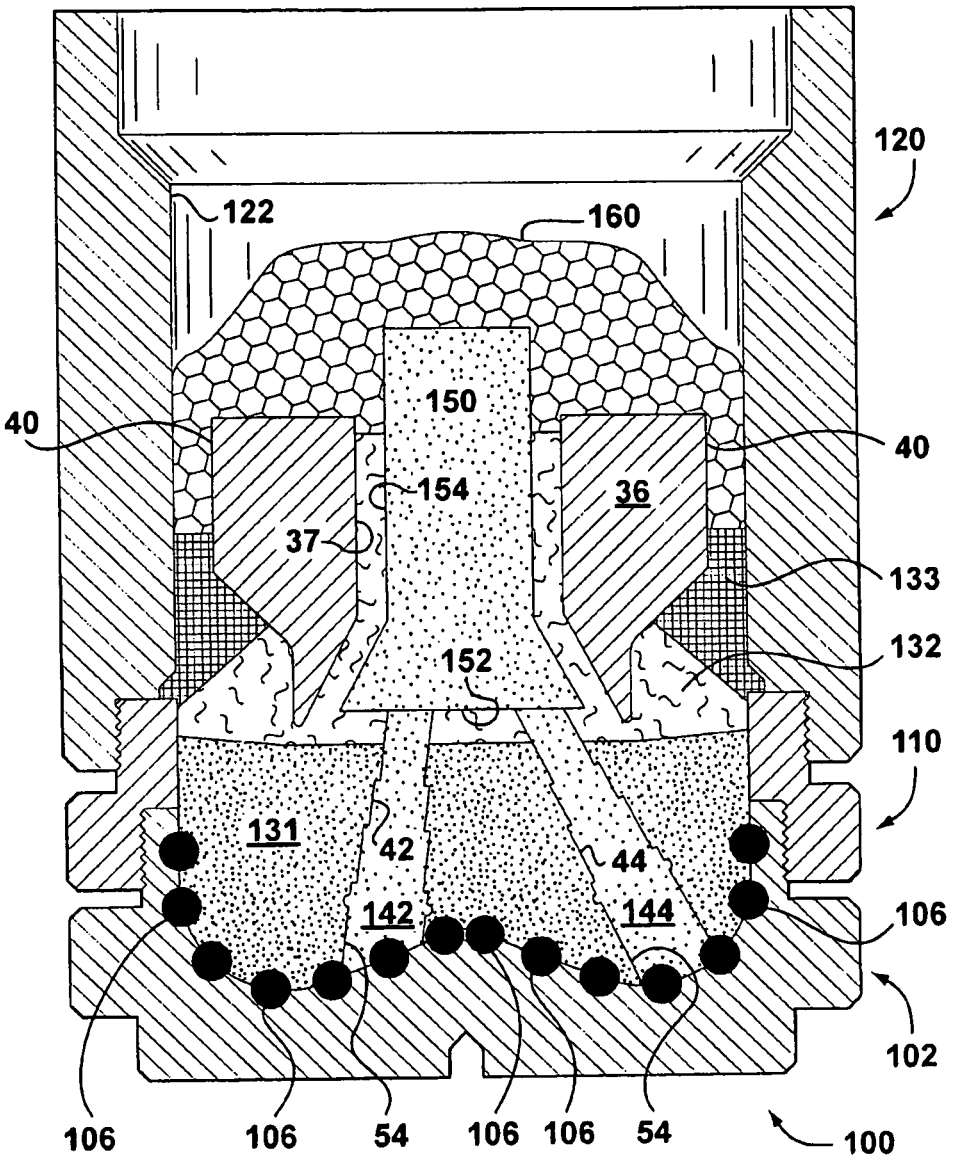
FIG. 2 is a schematic drawing in section with portions broken away showing one example of a mold assembly with a first matrix material and a second matrix material satisfactory for forming a matrix drill bit in accordance with teachings of the present disclosure.
Figure 3:
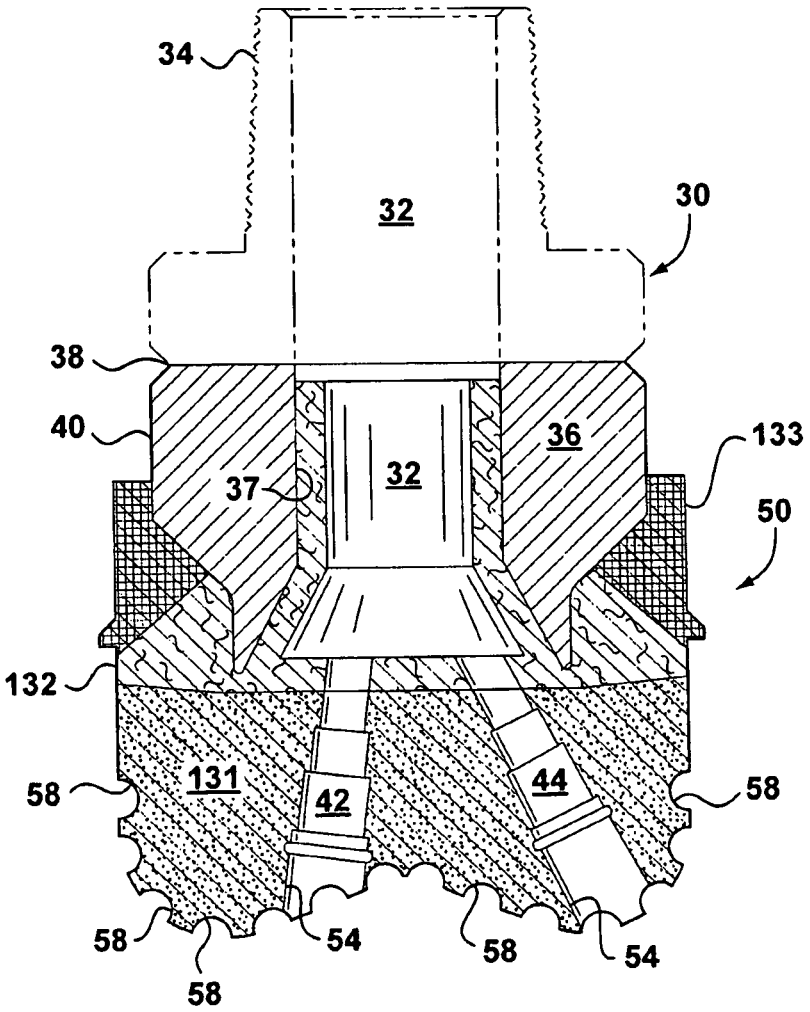
FIG. 3 is a schematic drawing in section with portions broken away showing a matrix bit body removed from the mold of FIG. 2 after binder material has infiltrated the first matrix material and the second matrix material.

A matrix drill bit may include a plurality of cutting elements, inserts, cutter pockets, cutter blades, cutting structures, junk slots, and/or fluid flow paths may be formed on or attached to exterior portions of an associated bit body. For embodiments such as shown in FIGS. 1, 2 and 3, a plurality of cutter blades 52 may form on the exterior of composite matrix bit body 50. Cutter blades 52 may be spaced from each other on the exterior of composite matrix bit body 50 to form fluid flow paths or junk slots therebetween.

A plurality of nozzle openings 54 may formed in composite bit body 50. Respective nozzles 56 may be disposed in each nozzle opening 54. For some applications nozzles 56 may be described as "interchangeable" nozzles. Various types of drilling fluid may be pumped from surface drilling equipment (not expressly shown) through a drill string (not expressly shown) attached with threaded pin or connection 34 and fluid flow passageways 32 to exit from one or more nozzles 56. The cuttings, downhole debris, formation fluids and/or drilling fluid may return to the well surface through an annulus (not expressly shown) formed between exterior portions of the drill string and interior of an associated well bore (not expressly shown).

A plurality of pockets or recesses 58 may be formed in blades 52 at selected locations. See FIG. 3. Respective cutting elements or inserts 60 may be securely mounted in each pocket 58 to engage and remove adjacent portions of a downhole formation. Cutting elements 60 may scrape and gouge formation materials from the bottom and sides of a wellbore during rotation of matrix drill bit 20 by an attached drill string. For some applications various types of polycrystalline diamond compact (PDC) cutters may be satisfactorily used as inserts 60. A matrix drill bit having such PDC cutters may sometimes be referred to as a "PDC bit". Pockets 58 may be selectively formed during the infiltration process by locating one or more sacrificial blanks 106 along the exterior of composite matrix bit body 50.

U.S. Pat. No. 6,296,069 entitled Bladed Drill Bit with Centrally Distributed Diamond Cutters and U.S. Pat. No. 6,302,224 entitled Drag-Bit Drilling with Multiaxial Tooth Inserts, incorporated herein by reference, show various examples of blades and/or cutting elements which may be used with a composite matrix bit body incorporating teachings of the present disclosure. It will be readily apparent to persons having ordinary skill in the art that a wide variety of fixed cutter drill bits, drag bits and other drill bits may be satisfactorily formed with a composite matrix bit body incorporating teachings of the present disclosure. The present disclosure is not limited to matrix drill bit 20 or any specific features as shown in the FIGURES.

Figure 4:
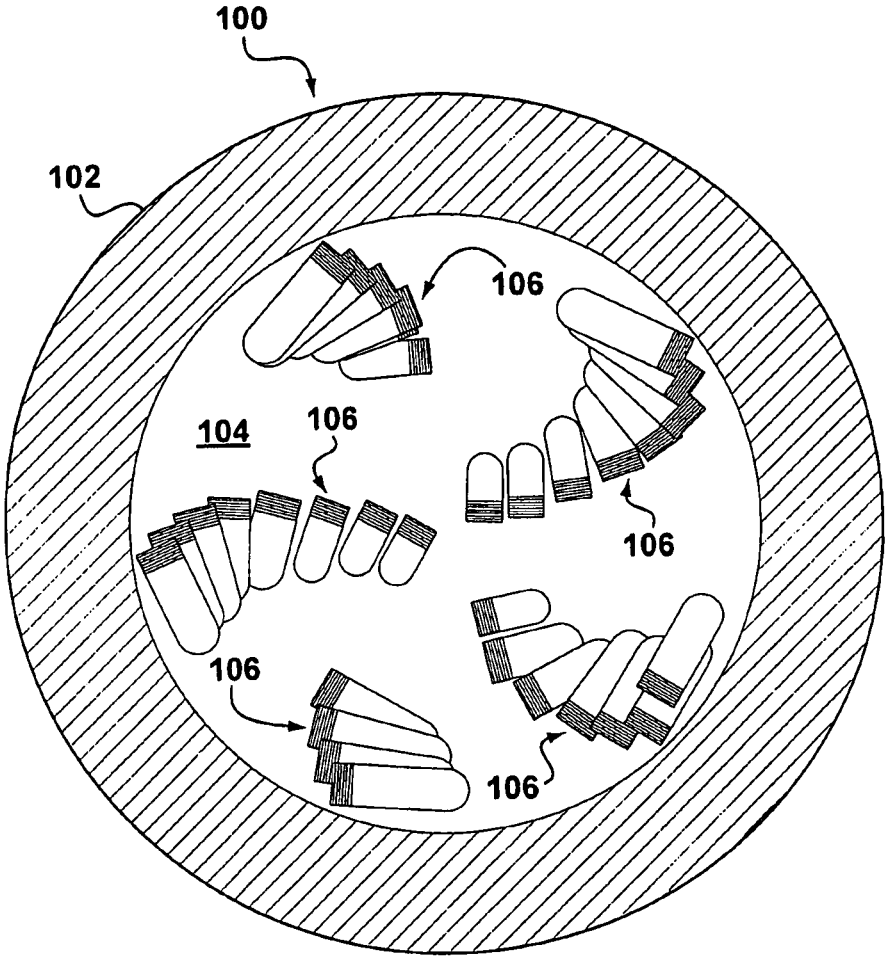
FIG. 4 is a schematic drawing in section showing interior portions of one example of a mold satisfactory for use in forming a matrix bit body in accordance with teachings of the present disclosure.

A wide variety of molds may be satisfactorily used to form a composite matrix bit body and associated matrix drill bit in accordance with teachings of the present disclosure. Mold assembly 100 as shown in FIGS. 2 and 4 represents only one example of a mold assembly satisfactory for use in forming a composite matrix bit body incorporating teachings of the present disclosure. U.S. Pat. No. 5,373,907 entitled Method And Apparatus For Manufacturing And Inspecting The Quality Of A Matrix Body Drill Bit, incorporated herein by reference, shows additional details concerning mold assemblies and conventional matrix bit bodies.

Mold assembly 100 as shown in FIGS. 2 and 4 may include several components such as mold 102, gauge ring or connector ring 110 and funnel 120. Mold 102, gauge ring 110 and funnel 120 may be formed from graphite or other suitable materials. Various techniques may be used including, but not limited to, machining a graphite blank to produce mold 102 with cavity 104 having a negative profile or a reverse profile of desired exterior features for a resulting fixed cutter drill bit. For example mold cavity 104 may have a negative profile which corresponds with the exterior profile or configuration of blades 52 and junk slots or fluid flow passageways formed therebetween as shown in FIG. 1.

As shown in FIGS. 2 and 4, a plurality of mold inserts 106 may be placed within cavity 104 to form respective pockets 58 in blades 52. The location of mold inserts 106 in cavity 104 corresponds with desired locations for installing cutting elements 60 in associated blades 52. Mold inserts 106 may be formed from various types of material such as, but not limited to, consolidated sand and graphite. Various techniques such as brazing may be satisfactorily used to install cutting elements 60 in respective pockets 58.

Various types of temporary displacement materials may be satisfactorily installed within mold cavity 104, depending upon the desired configuration of a resulting matrix drill bit. Additional mold inserts (not expressly shown) formed from various materials such as consolidated sand and/or graphite may be disposed within mold cavity 104. Various resins may be satisfactorily used to form consolidated sand. Such mold inserts may have configurations corresponding with desired exterior features of composite bit body 50 such as fluid flow passageways formed between adjacent blades 52.

Composite matrix bit body 50 may include a relatively large fluid cavity or chamber 32 with multiple fluid flow passageways 42 and 44 extending therefrom. See FIG. 3. As shown in FIG. 2, displacement materials such as consolidated sand may be installed within mold assembly 100 at desired locations to form portions of cavity 32 and fluid flow passages 42 and 44 extending therefrom. Such displacement materials may have various configurations. The orientation and configuration of consolidated sand legs 142 and 144 may be selected to correspond with desired locations and configurations of associated fluid flow passageways 42 and 44 communicating from cavity 32 to respective nozzle outlets 54. Fluid flow passageways 42 and 44 may receive threaded receptacles (not expressly shown) for holding respective nozzles 56 therein.

A relatively large, generally cylindrically shaped consolidated sand core 150 may be placed on the legs 142 and 144. Core 150 and legs 142 and 144 may be sometimes described as having the shape of a "crow's foot." Core 150 may also be referred to as a "stalk." The number of legs extending from core 150 will depend upon the desired number of nozzle openings in a resulting composite bit body. Legs 142 and 144 and core 150 may also be formed from graphite or other suitable material.

After desired displacement materials, including core 150 and legs 142 and 144, have been installed within mold assembly 100, a first matrix material 131 having optimum fracture resistance characteristics (toughness) and optimum erosion, abrasion and wear resistance, may be placed within mold assembly 100. Matrix material 131 will preferably form a first zone or a first layer which will correspond approximately with exterior portions of composite matrix bit body 50 which contact and remove formation materials during drilling of a wellbore. The amount of first matrix material 131 added to mold assembly 120 will preferably be limited such that matrix material 131 does not contact end 152 of core 150. The present disclosure allows the use of matrix materials having optimum characteristics of toughness and wear resistance for forming a fix cutter drill bit or drag bit.

A generally hollow, cylindrical metal blank 36 may then be placed within mold assembly 100. Metal blank 36 preferably includes inside diameter 37 which is larger than the outside diameter of sand core 150. Various fixtures (not expressly shown) may be used to position metal blank 36 within mold assembly 100 at a desired location spaced from first matrix material 131.

Second matrix material 132 may then be loaded into mold assembly 100 to fill a void space or annulus formed between outside diameter 154 of sand core 150 and inside diameter 37 of metal blank 36. Second matrix material 132 preferably covers first matrix material 131 including portions of first matrix material 131 located adjacent to and spaced from end 152 of core 150.

For some applications second matrix material 132 is preferably loaded in a manner that eliminates or minimizes exposure of second matrix material 132 to exterior portions of composite matrix bit body 50. First matrix material 131 may be primarily used to form exterior portions of composite matrix bit body 50 associated with cutting, gouging and scraping downhole formation materials during rotation of matrix drill bit 20 to form a wellbore. Second matrix material 132 may be primarily used to form interior portions and exterior portions of composite matrix bit body 50 which are not normally associated cutting, gouging and scraping downhole formation materials. See FIGS. 2 and 3.

For some applications third matrix material 133 such as tungsten powder may then be placed within mold assembly 100 between outside diameter 40 of metal blank 36 and inside diameter 122 of funnel 120. Third matrix material 133 may be a relatively soft powder which forms a matrix that may subsequently be machined to provide a desired exterior configuration and transition between matrix bit body 50 and metal shank 36. Third matrix 133 may sometimes be described as an "infiltrated machinable powder." Third matrix material 133 may be loaded to cover all or substantially all second matrix material 132 located proximate outer portions of composite matrix bit body 50. See FIGS. 2 and 3.

During the loading of matrix material 131, 132 and 133 care should be taken to prevent undesired mixing between first matrix material 131 and second matrix material 132 and undesired mixing between second matrix material 132 and third matrix material 133. Slight mixing at the interfaces to avoid sharp boundaries between different matrix materials may provide smooth transitions for bonding between adjacent layers. Prior experience and testing has demonstrated various problems associated with infiltrating cemented carbides and spherical carbides with hot, liquid binder material when the cemented carbides and spherical carbides are disposed in geometrically complex mold assemblies associated with matrix bit bodies for fixed cutter drill bits. Similar problems have been noted when attempting to form matrix bodies with cemented carbides and/or spherical carbides for other types of complex downhole tools associated with drilling and producing oil and gas wells.

Manufacturing problems and resulting quality problems associated with using cemented carbides and/or spherical carbides as matrix material are generally associated with lack of infiltration, porosity, shrinkage, cracking and segregation of binder material constituents within interior portions of a resulting matrix bit body. Relatively complicated, intricate designs and relatively large sizes of many fixed cutter drill bits present difficult challenges to manufacturability of bit bodies having cemented carbides and/or spherical carbides as the matrix materials. These same quality problems may occur during manufacture of other downhole tools formed at least in part by a matrix of cemented carbides and spherical carbides such as reamers, underreamers, and combined reamers/drill bits. One example of such combined downhole tools is shown in U.S. Pat. No. 5,678,644 entitled "Bi-center And Bit Method For Enhanced Stability," incorporated herein by reference.

Previous testing and experimentation associated with premixing cemented carbides and/or spherical carbides with macrocrystalline tungsten carbide and/or cast carbide powders often failed to produce a sound, high quality matrix bit body. Increasing soak time of binder material within such mixtures of cemented carbides and/or spherical carbides with macrocrystalline tungsten carbide and/or cast carbide powders did not substantially eliminate quality problems related to shrinkage, alloy segregation, lack of infiltration, porosity and other problems associated with unsatisfactory infiltration of cemented carbides and/or spherical carbides. Also, increasing the temperature of hot, liquid binder material used for infiltration of such mixtures did not substantially reduce associated quality problems. High alloy segregation in the last solidifying portion of liquid binder material within various mixtures of cemented carbides and/or spherical carbides with macrocrystalline tungsten carbide and/or cast carbides was identified as one cause for lack of bonding within such mixtures, undesired shrinkage, porosity and other quality problems.

The use of first matrix material 131 to form a first layer or zone in combination with using second matrix material 132 to form a second layer or zone adjacent to first matrix material 131 may substantially reduce or eliminate alloy segregation in the last solidifying portion of hot, liquid binder material with first matrix material 131. The addition of second matrix material 132 in the annulus formed between outside diameter 154 of core 150 and inside diameter 37 of metal blank 36 and covering first matrix material 131 such as shown in FIG. 2 may substantially reduce or eliminate problems related to lack of infiltration, porosity, shrinkage, cracking and/or segregation of binder constituents within first matrix material 131. One reason for these improvements may be the ease with which hot, liquid binder material infiltrates macrocrystalline tungsten carbide and/or cast carbide powders.

As previously noted, hot, liquid binder material may leach or remove small quantities of alloys and/or other contaminates from bonding materials used to form cemented carbides. The leached alloys and/or other contaminates may have a higher melting point than typical binder materials associated with fabrication of matrix drill bits. Therefore, the leached alloys and/or other contaminates may solidify in small gaps or voids formed between adjacent cemented carbide pellets, spheres or other shapes and block further infiltration of hot, liquid binder material between such cemented carbide shapes.

The "contaminated" infiltrant or hot, liquid binder material may have solidus and liquidus temperatures different from "virgin" binder materials. Further "enrichment" of an infiltrant with contaminants may take place during solidification of the binder material as a result of rejection of solute contaminants into hot liquid ahead of a solidification front. Besides segregation of contaminants (solute) in later stages of solidification, any lack of directional solidification may give rise to potential problems including, but not limited to, shrinkage, porosity and/or hot tearing.

Macrocrystalline tungsten carbide and cast carbide powders may be substantially free of alloys or other contaminates associated with bonding materials used to form cemented carbides. The second matrix material may be selected to have less than five percent (5%) alloys or potential other contaminates. Therefore, infiltration of hot, liquid binder material through a second matrix material selected in accordance with teachings of the present disclosure will generally not leach significant amounts of alloys or other potential contaminates.

First matrix material 131 may be cast carbides, monocrystalline carbides, and/or spherical carbides as previously discussed. Alloys of cobalt, iron, and/or nickel may be used to form cemented carbides and/or spherical carbides. For some matrix drill bit designs an alloy concentration of approximately six percent in the first matrix material may provide optimum results. Alloy concentrations between three percent and six percent and between approximately six percent and fifteen percent may also be satisfactory for some matrix drill bit designs. However, alloy concentrations greater than approximately fifteen percent and alloy concentrations less than approximately three percent may result in less than optimum characteristics of a resulting matrix bit body.

Second matrix material 132 may be spherical carbides, monocrystalline tungsten carbide, and/or cast carbide powders. Examples of such powders include P-90 and P-100 which are commercially available from Kennametal, Inc. located in Fallon, Nev. U.S. Pat. No. 4,834,963 entitled "Macrocrystalline Tungsten Monocarbide Powder and Process for Producing" assigned to Kennametal, incorporated herein by reference, describes techniques which may be used to produce macrocrystalline tungsten carbide powders. Third matrix material 133 may be tungsten powder such as M-70, which is also commercially available from H. C. Starck, Osram Sylvania and Kennametal and also commercially available from Alloyne Powder Technologies. Typical alloy concentrations in second matrix material 132 may be between approximately one percent and two percent. Second matrix materials having an alloy concentration of approximately five percent or greater may result in unsatisfactory operating characteristics for an associated matrix bit body.

A typical infiltration process for casting composite matrix bit body 50 may begin by forming mold assembly 100. Gage ring 110 may be threaded onto the top of mold 102. Funnel 120 may be threaded onto the top of gage ring 110 to extend mold assembly 100 to a desired height to hold previously described matrix materials and binder material. Displacement materials such as, but not limited to, mold inserts 106, legs 142 and 144 and core 150 may then be loaded into mold assembly 100 if not previously placed in mold cavity 104. Matrix materials 131, 132, 133 and metal blank 36 may be loaded into mold assembly 100 as previously described.

As mold assembly 100 is being filled with matrix materials, a series of vibration cycles may be induced in mold assembly 100 to assist packing of each layer or zone or matrix materials 131, 132 and 133. The vibrations help to ensure consistent density of each layer of matrix materials 131, 132 and 133 within respective ranges required to achieve desired characteristics for composite matrix bit body 50. Undesired mixing of matrix materials 131, 132 and 133 should be avoided.

Binder material 160 may be placed on top of layers 132 and 133, metal blank 36 and core 150. Binder material 160 may be covered with a flux layer (not expressly shown). A cover or lid (not expressly shown) may be placed over mold assembly 100.

Figure 5:
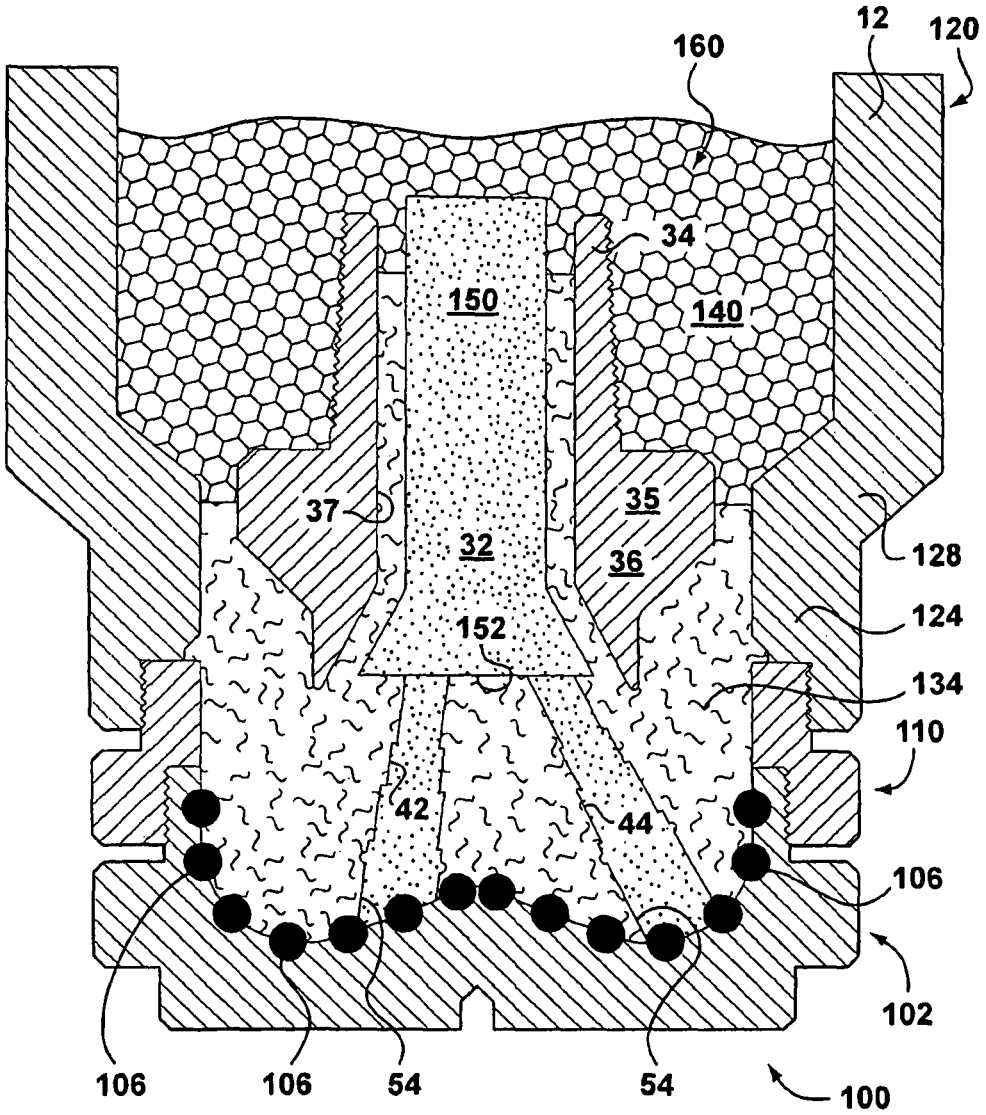
FIG. 5 is a cross-sectional, side view of a mold assembly and contents.

FIG. 5 illustrates a cross-sectional, side view of an alternative mold assembly 100. The molding structures comprise mold 102, gauge or connector ring 110, and funnel 120. The funnel 120 is made of smaller diameter cylindrical section 124, larger diameter cylindrical section 126, and transitional section 128. Smaller diameter cylindrical section 124 has a relatively smaller inside diameter than larger diameter cylindrical section 126. Smaller diameter cylindrical section 124 is joined to larger diameter cylindrical section 126 by transitional section 128 such that transitional section 128 is positioned between the cylindrical sections. Smaller diameter cylindrical section 124 of funnel 120 is made-up to gauge or connector ring 110, wherein gauge or connector ring 110 is made-up to mold 102.

FIG. 5 further illustrates that displacement materials such as consolidated sand are installed within mold assembly 100 at desired locations to form portions of cavity 32 and fluid flow passages 42 and 44 extending therefrom. Sand legs 142 and 144 may be selected to correspond with desired locations and configurations of associated fluid flow passageways 42 and 44 communicating from cavity 32 to respective nozzle outlets 54. Sand core 150 may be placed on sand legs 142 and 144. After desired displacement materials, including core 150 and legs 142 and 144, have been installed within mold assembly 100, a first portion of matrix material 134 is added to fill up mold 102 and gauge or connector ring 110 so as to almost contact end 152 of core 150. A blank pin 35 is then placed within mold assembly 100 coaxially around sand core 150. Blank pin 35 has an inside diameter 37 which is larger than the outside diameter of sand core 150. Blank pin 35 comprises a unitary casting blank 36 and threaded pin 34. Various fixtures (not expressly shown) may be used to position blank pin 35 within mold assembly 100 at a desired location spaced from the first portion of matrix material 134. A second portion of matrix material 134 is added to fill up a gap between blank pin 35 and smaller diameter cylindrical section 124 as well as an annular gap between sand core 150 and blank pin 35. The mold assembly 100 may be vibrated to pack the matrix material 134. Binder material 160 is placed on top of matrix material 134, blank pin 35, and sand core 150. In particular, binder material 160 fills an annular region 140. Binder material 160 may be covered with a flux layer (not expressly shown). A cover or lid (not expressly shown) may be placed over mold assembly 100.

Figure 6:
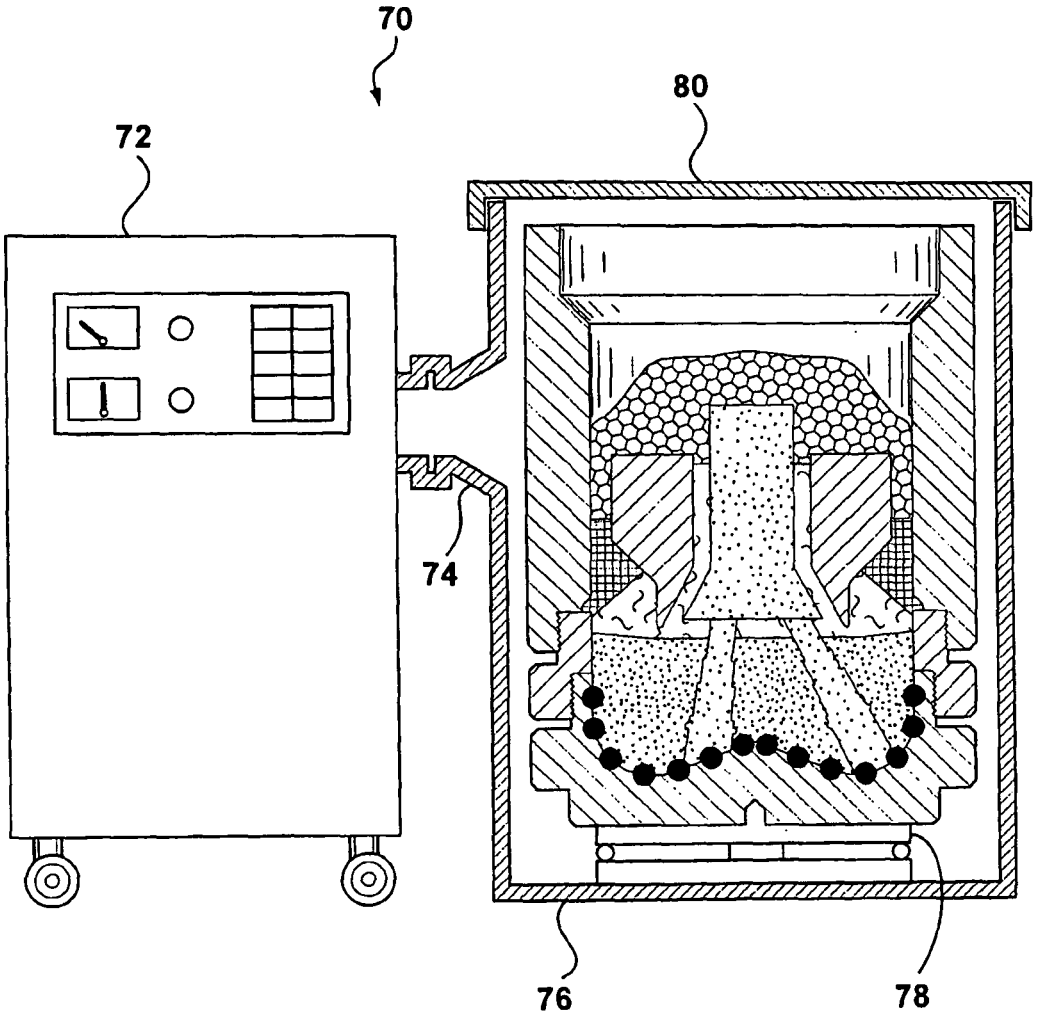
FIG. 6 is a side view of a microwave system for a mold assembly.
Figure 7:
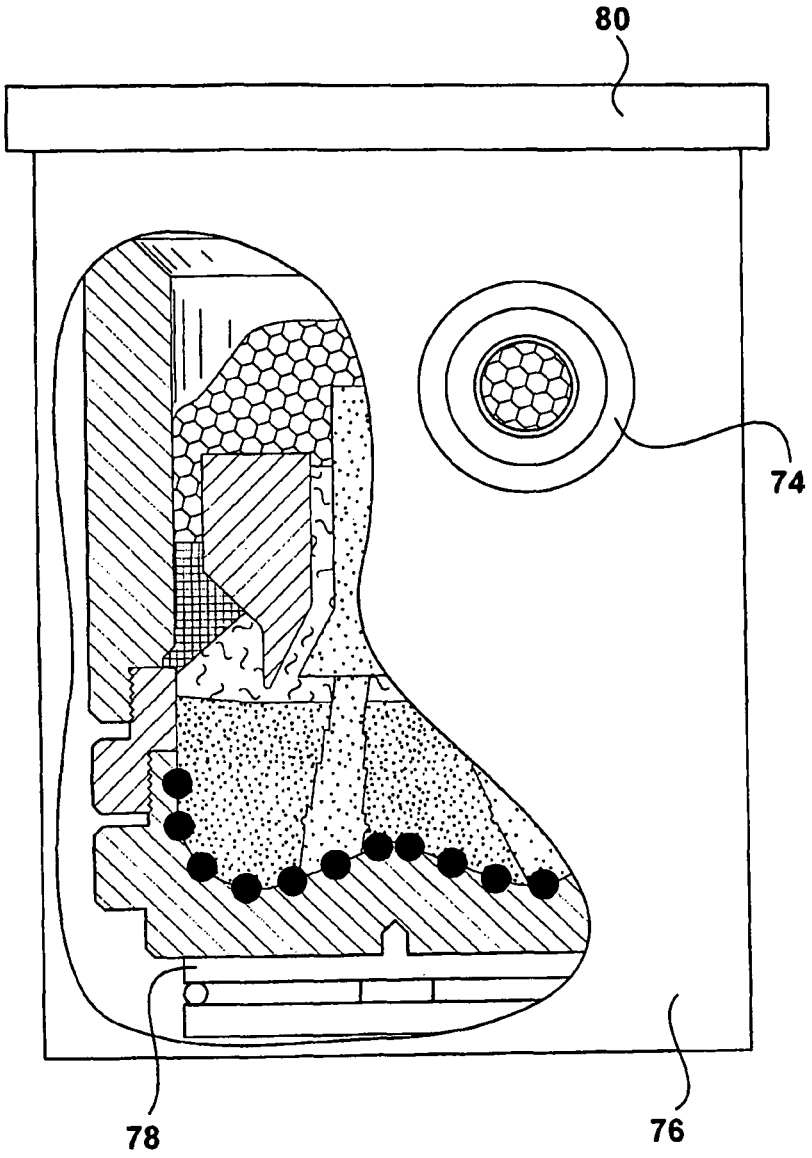
FIG. 7 is a side view with cut-a-way views of an insulative oven.

Referring to FIGS. 6 and 7, a microwave process for heating binder material 160 is now described. Mold assembly 100 and materials disposed therein may then be placed in a microwave system 70. FIG. 6 illustrates a side, cross-sectional view of microwave system 70. FIG. 7 illustrates a perspective, cut-away view looking directly into a wave guide of microwave system 70. The microwave system 70 may comprise microwave generator 72, wave guide 74, and insulative oven 76. Microwave generator 72 generates high frequency microwave radiation and directs the radiation toward wave guide 74. The microwave radiation is conveyed by wave guide 74 to insulative oven 76.

Microwave generator 72 may be equipped with a power control and a timer. It may produce microwave energy of between about 0.5 GHz and about 10 GHz frequency, in particular about 2.45 GHz frequency, and power output of 900-20,000 W, in particular about 6,000 W. Microwave generator 72 may generate a combined electronic and magnetic field, or it may generate an electromagnetic field. Wave guide 74 and insulative oven 76 may be insulated with Fiberfrax boards or any other known insulative material. The demonstrative insulative oven 76 has a cylindrical body that is closed at the bottom and open at the top. Oven lid 80 may be placed on the opening at the top. Insulative oven 76 may also have a turn table 78.

Wave guide 72 may be connected to insulative oven 76 at a height and transverse location so as to focus the microwave radiation on binder material 160 in mold assembly 100. (See FIGS. 6 and 7). In particular, wave guide 74 may be offset from the center of insulative oven 76 so that microwave radiation is directed through wave guide 74 to binder material 160 located in annular region 140 above blank pin 35 or casting blank 36, depending on the application, and defined between sand core 150 and funnel 120. The microwave radiation heats binder material 160 to a melting temperature without overheating blank pin 35 or casting blank 36. In certain embodiments of the invention, a water jacket (not shown) may be placed around the threaded pin 34 to reduce the amount of heat transferred to the threaded pin 34. If the insulative oven 76 is equipped with turn table 78, the mold assembly 100 may be rotated so that binder material 160 in annular region 140 passes into and out of the focused microwave radiation as the mold assembly rotates. The rotation of mold assembly 100 may more evenly heat binder material 160 in annular region 140 so as to allow binder material 160 to evenly flow down into the matrix materials 131, 132 and 133.

When the melting point of binder material 160 is reached, liquid binder material 160 may infiltrate matrix materials 131, 132 and 133 or matrix material 134, whatever the case may be. As previously noted, second matrix material 132 allows hot, liquid binder material 160 to more uniformly infiltrate first matrix material 131 to avoid undesired segregation in the last solidifying portions of liquid binder material 160 with first matrix material 131. In some cases, matrix materials 131, 132, and 133 or matrix material 134 must also reach a temperature near the melting point of binder material 160 to allow complete infiltration of binder material 160.

Upper portions of mold assembly 100 such as funnel 120 may have increased insulation (not expressly shown) as compared with mold 102. As a result, hot, liquid binder material in lower portions of mold assembly 100 will generally start to solidify with first matrix material 131 before hot, liquid binder material solidifies with second matrix material 132. The difference in solidification may allow hot, liquid binder material to "float" or transport alloys and other potential contaminates leached from first matrix material 131 into second matrix material 132. Since the hot, liquid binder material infiltrated through second matrix material 132 prior to infiltrating first matrix material 131, alloys and other contaminates transported from first matrix material 131 may not affect the quality of the resulting matrix bit body 50 as much as if the alloys and other contaminates had remained within first matrix material 131. Also, the second matrix material preferably contains less than four percent (4%) of such alloys or contaminates.

Proper infiltration and solidification of binder material 160 with first matrix material 131 is particularly important at locations adjacent to features such as nozzle openings 54 and pockets 58. Improved quality control from enhanced infiltration of binder material 160 into portions of first matrix material 131 which forms respective blades 52 may allow designing thinner blades 52. Blades 52 may also be oriented at more aggressive cutting angles with greater fluid flow areas formed between adjacent blades 52.

In alternative forms of the invention, a single matrix material 134 is placed in the mold assembly. While portions of the matrix material may be placed in the mold assembly in stepwise fashion, the entirety of the matrix material may be uniform.

After the binder material 160 has infiltrated matrix materials 131, 132, and 133, mold assembly 100 may then be removed from insulative oven 76 and cooled at a controlled rate. Once cooled, mold assembly 100 may be broken away to expose composite matrix bit body 50 as shown in FIG. 3. Subsequent processing according to well-known techniques may be used to produce matrix drill bit 20.

In some embodiments of the invention, focused microwave radiation may be used to heat specific portions of the mold assembly during the cooling process. This may be particularly applicable where the matrix and binder contract upon cooling. Referring to FIG. 2, after binder material 160 has completely infiltrated the matrix material, the mold assembly may be allowed to cool. As first matrix material 131 begins to cool in the lower portion of mold assembly 100, it begins to contract so as to pull second and third matrix materials 132 and 133 downwardly. If the contraction is significant, second and third matrix materials 132 and 133 may tear away from or lose contact with the underside of casing blank 36. Given the significant shear stresses molded bits must endure, it may be important to maintain a strongly bound interface between the underside of casting blank 36 and second and third matrix materials 132 and 133. To prevent this tear away phenomenon, microwave radiation may be focused on second and third matrix materials 132 and 133 directly under casing blank 36 to assist binder material 160 and second and third matrix materials 132 and 133 to settle relative to and remain adhered to casting blank 36 as first matrix material 131 cools and contracts. Application of microwave radiation at the interfaces between matrix materials 131, 132 and/or 133 may relieve stress that might otherwise accumulate during the cooling process.

Because microwave radiation may control the amount of heat supplied to casting blank 36, differences in thermal expansion rates between casting blank 36 and the matrix materials may be reduced. Thermal expansion cracks may be reduced or eliminated. The application of microwave radiation may also allow implementation of binder materials other than Cu—Ni based binders. Any binder material known to persons of skill in the art may be implemented. The binder material may be selected for use with particular matrix materials to enhance material properties such as TRS, erosion, abrasion, and impact toughness. By adjusting the temperature profile in portions of the mold assembly during the molding process, grain boundary growth may be increased or decreased in different portions as desired.

In certain embodiments of the invention, microwave radiation may be used to establish different temperature zones within a mold. Temperature zones may be designed to allow binder material to flow into a matrix material, but they may also be designed to give the bound matrix material certain properties. The temperature and time at which temperatures are maintained are both factors tending to bound matrices certain material properties. With microwave radiation, temperature zones may be established to give the bound matrix of one zone different material properties than the bound matrix in another zone. Because microwave radiation provides an ability to establish different temperature zones within a single mold, different matrix materials and binder materials may also be used to design bits having different material properties at various portions of the bits. In particular, different matrix materials may be used in different portions of the bit to give different material properties in various portions of the bit. Different binder materials may also be used in different portions of the bit to give different material properties in various portions of the bit. All three factors, matrix material, binder material, and temperature may be adjusted and modified to create desired material properties at various portions of the bit.

Regarding binder materials, depending on the particular temperatures established with microwave radiation in various portions of the bit within a mold, the components of the binder material may be adjusted to provide desirable properties. For example, the weight percentages of copper (Cu), nickel (Ni), cobalt (Co), iron (Fe), molybdenum (Mo), manganese (Mn), tin (Sn), zinc (Zn), silicon (Si), tungsten (W), boron (B) and phosphorous (P) may be adjusted.

Regarding matrix material, depending on the particular temperatures established with microwave radiation in various portions of the bit within a mold, the components of the matrix material may be adjusted to provide desirable properties. For example, Macrocrystalline tungsten carbide powders may be modified to have different weight percentages of monotungsten carbide, cast carbide, Ni, Fe, Carbonyl of Fe, Ni, etc.

The microwave casting processes of the present invention may also allow for different binder materials. Any material known to bind matrix materials may be used with the microwave radiation heating process described herein.

Figure 8:
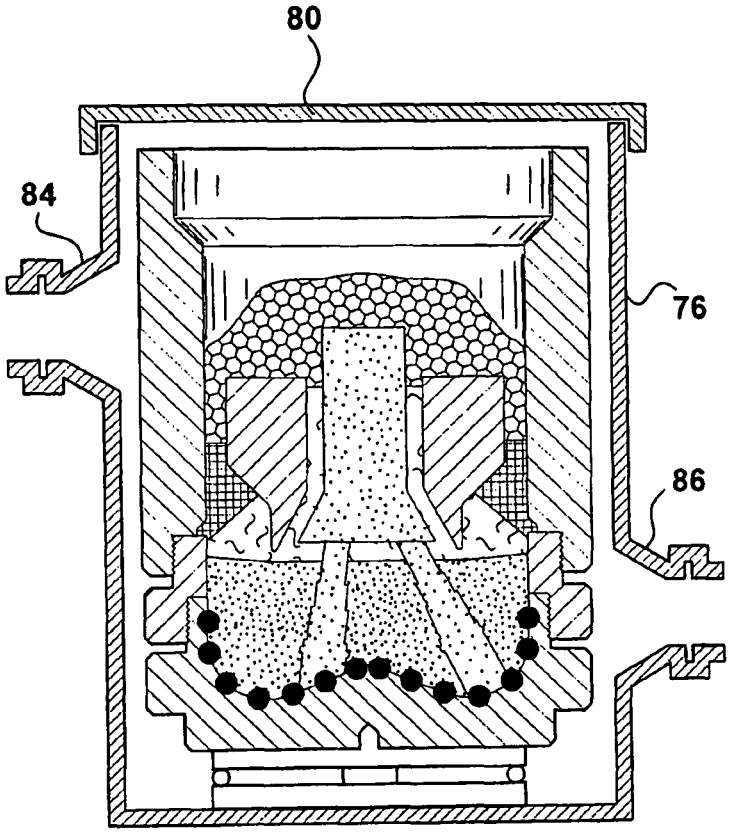
FIG. 8 is a cross-sectional, side view of an insulative oven with multiple wave guides.

Referring to FIG. 8, an alternative insulative oven 76 of a microwave system 70 is illustrated. FIG. 8 is a cross-sectional, side view of insulative oven 76. A first wave guide 84 is attached to an upper portion of insulative oven 76 so as to direct microwave radiation to binder material 160 located above second matrix material 132 and third matrix material 133 in annular region 140. A second wave guide 86 is attached to a lower portion of insulative oven 76 so as to direct microwave radiation to first matrix material 131. First and second microwave generators 72 (not expressly shown) are attached to first and second wave guides 84 and 86. Binder material 160 is initially heated to at least its melting temperature by microwave radiation from first wave guide 84. As molten binder material 160 infiltrates second and third matrix materials 132 and 133, it may have a tendency to cool because the matrix materials are not being heated directly by the microwave radiation. To prevent molten binder material 160 from solidifying before it reaches the bottom of first matrix materials 131, microwave radiation from second wave guide 86 heats the binder material 160 and first matrix material 131.

In alternative embodiments of the present invention, any number of wave guides and microwave generators are employed to direct microwave radiation to various parts of a mold assembly to provide optimal heat distributions. Further, microwave generators may be adjusted to apply certain power levels for certain periods of time depending on how the binder material is intended to infiltrate the matrix material.

Depending on the particular application, microwave radiation may be combined with isotropic heating to heat desirable components within a mold assembly. For example, the entire insulative oven 76 may be placed in a conventional isotropic furnace to transfer heat through mold 102, gauge or connector ring 110 and funnel 120 to the contents of mold assembly 100. Isotropic heat transfer through the walls of insulative oven 76 may be enhanced by placing the walls of insulative oven 76 in direct contact with mold 102, gauge or connector ring 110, and funnel 120. Alternatively, only portions of insulative oven 76 may be placed in a conventional isotropic furnace to transfer heat through exposed portions of the insulative oven 76. For example, in some applications it may be desirable to place the walls of insulative oven 76 in direct contact with mold 102 and to expose only the lower portion of the insulative oven 76 to a conventional isotropic furnace to transfer heat through mold 102. Any method known to persons of skill may be applied to heat components of the mold assembly in conjunction with microwave radiation.

Compared to a conventional isotropic heating, the microwave casting processes of the present invention may require much less time and less energy to infiltrate the binder material into the matrix material. In some applications, the process time may be reduced from 5 hours to 1 hour. In addition to a faster heating cycle, the microwave casting process may provide a faster cooling cycles as only portions of the mold assembly must be cooled. The microwave casting process may reduce casting failures in terms of scrap and facilitate additional materials and material properties with much less energy input resulting in reducing cycle time, energy costs and providing enhanced material properties. Because the heating cycle may be much shorter, in some microwave casting processes of the present invention, it may not be necessary to add a flux layer on top of the binder material.

As illustrated in FIG. 5, the microwave casting processes of the present invention may allow for implementation of a blank pin 35 because the microwave radiation is focused to heat binder material 160 without overheating the upper section with API tool joint (threaded pin 34). By using a unitary blank pin 35, a step in the conventional bit production process is eliminated, e.g., welding a threaded pin 34 to a casting blank 36 at an annular weld groove 38 (see FIG. 3). Further, the microwave casting processes of the present invention may provide for implementation of a much shorter blank pin 35. Bits of shorter length may be advantageous in directional drilling applications. Further, shorter bits provide a driller with more room to make-up more down hole tools.

Figure 9:
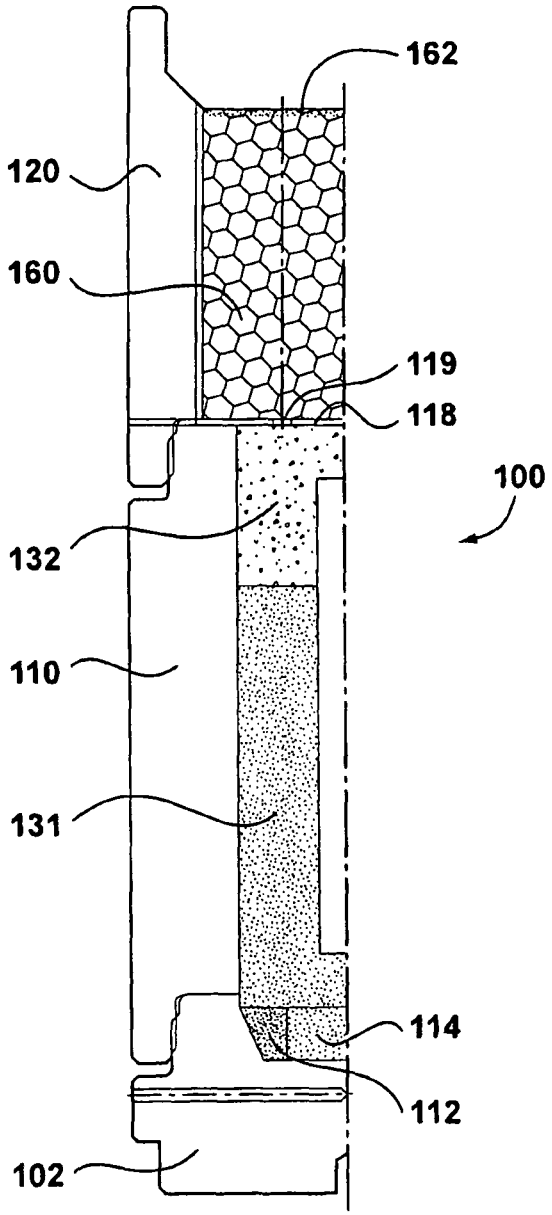
FIG. 9 is a cross-sectional, side view of a billet mold.

A cross-sectional, side view (left side only) of an embodiment of a mold assembly for a billet mold is shown in FIG. 9. Mold assembly 100 comprises mold 102, gauge or connection ring 110, and funnel 120. Mold assembly 100 is filled with clay 112 and sand 114. A threaded steel rod 116 is positioned within mold assembly 100 adjacent gauge or connector ring 110. A first matrix material 131, such as a test powder, is placed in mold assembly 100 between threaded steel rod 116 and gauge or connector ring 110. A second matrix material 132, such as M/O, is placed in mold assembly 100 over first matrix material 131. A baffle plate 118 is placed over second matrix material 132. Baffle plate 118 may be made of graphite and may have any number of holes 119 spaced across the plate. Binder material 160 is placed in mold assembly 100 on top of baffle plate 118. Flux 162 may be place on top of binder material 160.

To make the billet, mold assembly 100 is placed in an insulative oven of a microwave system as previously described. Binder material 160 is melted to at least its melting temperature by microwave radiation from the microwave system. As described above, the microwave radiation may be focused on binder material 160 above baffle plate 118. The mold assembly 100 may be rotated as the binder material is irradiated. As binder material 160 melts, it flows down through holes 119 in baffle plate 118 to infiltrate second and first matrix materials 132 and 131. The size and number of holes 119 may serve to regulate and evenly distribute liquid binder material 160 to the matrix materials. Depending on the particular application, multiple baffle plates may be used. As described above, the microwave system may comprise more than one wave guide so as to focus microwave radiation on portions of the matrix material as well as the binder material. Isothermal heating may also be used to heat materials in assembly mold 100. Once binder material 160 has infiltrated matrix materials 131 and 132, the billet is allowed to cool and mold assembly 110 is removed from the billet.

Depending on the particular baffle plate used and the placement of the baffle plate, the baffle plate may serve to create a slip plane or break plane between bound matrix material formed in the mold below the baffle plate and excess binder material that remains above the baffle plate. After the materials have solidified sufficiently, the excess binder material may be broken away from the bound matrix material at the baffle plate.

In all of these embodiments, a layer of flux material may be applied above the binder material. The flux may remove oxidation and/or oxidants from the binder so as to clean the binder material.

Referring to FIG. 10, a cross-sectional, side view of a bit mold and a insulative oven. In this embodiment of the invention, funnel 120 is relatively shorter to allow access to matrix material 134. Insulative oven 76 has a lay down pipe 77 extending from the insulative oven to a position immediately above matrix material 134 between funnel 120 and blank pin 35. Inside insulative oven 76, there is a liner 81 filled with binder material 160. Microwave radiation may be used to heat binder material 160 to a desired temperature. Upon reaching the desired temperature, a valve of any known design may be used to allow binder material 160 to flow from insulative oven 76 to the top of matrix material 134. As binder material 160 is laid down on matrix material 134, mold assembly 100 may be rotated relative to laydown pipe 77 so as to laydown and even layer of binder material 160. An additional laydown pipe 77 may be used to deliver binder material 160 to the matrix material between sand core 150 and threaded pin 34. As described above, microwave radiation and/or other forms of heat delivery may be used to heat the mold assembly or just matrix material 134. In some applications, a water jacket 90 may be placed over threaded pin 34 to insulate blank pin 35 from excessive heating. Water jacket 90 may have inflow 91 and outflow 92 to circulate a cooling fluid through the water jacket. By heating the binder material in a separate insulative oven and using a laydown tube delivery device, microwave radiation may be focused on the binder material without overheating blank pin 35. Relative to FIG. 10, microwave radiation is illustrated as the way to heat the binder material, but in alternative methods, any known method of heating may be applied to heat the binder material, such as induction coils, convection ovens, radiated heat, etc.

In further embodiments of the invention, a mold assembly similar to that illustrated in FIG. 10 may be employed. However, rather than a single insulative oven, multiple insulative ovens may be used to deliver a plurality of binder materials to the matrix material. In particular, a first binder material may be laid down by a first insulative oven. After the first binder material has flowed down through the matrix material, a second binder material may be laid down by a second insulative oven. Any number of binder material compositions may be flowed into the matrix material. By this process, different binder material may be delivered to the matrix material at pockets 58 than may be delivered to the matrix material near blank pin 35.

Thermocouples and valves may be used to monitor and control temperature and flow rates at various portions of the mold assembly. The amount of a particular binder material delivered to a mold assembly may be monitored by a volume flow rate monitor or simply by weighing the mold assembly as the binder material is being delivered.

FIG. 11 illustrates a cross-sectional, side view of a mold assembly within an insulative oven. Mold assembly 100 is suspended in insulative oven 76 via hook 108 so that mold assembly 100 may be raised and lowered relative to wave guides 84 and 86. Depending on the particular molding process, it may be desirable to heat certain portion of the mold assemble sequentially. For example, as a binder material flows down through a matrix material, the mold assembly may be raised relative to the wave guide so as to focus microwave radiation at the leading edge of the binder material as it moves through the matrix material. Hook 108 could also be used to rotate mold assembly 100. Any means known to persons of skill in the art may be used to vertically translate and/or rotate mold assembly 100 relative to wave guides 84 and 86. By focusing microwave radiation on the portions of the mold assembly intended to stay warm, the use of hot hats, warming blankets, etc., may be disbanded and/or used in conjunction with the microwave heating.

FIG. 11 further illustrates a device for cooling a portion of the mold assembly. Spray nozzle 95 may be positioned under mold assembly 100 to spray cooling fluid on mold 102. Alternatively, any cooling method and/or apparatus may be used to cool portions of the mold, including but not limited to liquid bath, water jacket, fluid conduits in the mold, air circulation, etc.

The mold components of the mold assembly may be graphite or ceramic. Any known material may be used that is acceptable for use with microwave radiation. Insulative materials may also be used in portions of the mold assembly where heat retention is desirable. Further, heat conduction materials may be used where it is desirable to radiate heat to/from the mold assembly. For example, a graphite disc may be used in the bottom of the mold assembly for cooling with spray nozzle 95.

Referring to FIG. 12, a cross-sectional, side view of an insulative oven and microwave system is shown. A perspective view of a bit is shown inside the insulative oven. As illustrated, microwave radiation may be used to preheat the bit body prior to a brazing operation wherein cutter inserts 60 are brazed into pockets 58 (see FIG. 2) of the bit body 50. In a typical braze operation, the bit head is preheated by an induction coil. After the bit has reached a threshold temperature, a torch is used to further heat the individual cutter/pocket combinations to melt the braze material in the interface between the cutter and the pocket. Brazing material may be placed in the pockets as the cutters are inserted prior to the preheating step. According to the present invention, induction coil heating may be omitted and microwave radiation may be used to preheat the bit head as shown in FIG. 12. After the bit head has been heated to a threshold temperature with microwave radiation, the cutter and/or pocket are then heated with a torch to melt the braze material to fix or braze the cutter in the pocket. This procedure may be done on either matrix body or steel body bits. The braze material may have a lower melting temperature than the melting temperature of any braze between the diamond cutting wafer and the stud (i.e. below approximately 1450° F.). Such braze material may be a silver copper brazing alloy commercially available and well known in the art and having a melting temperature in the range of 1100° F.-1300° F. However, other brazing materials may also be suitable. As shown in FIG. 12, the bit body may be rotated on turntable 78 and/or vertically translated on hook 108 (See FIG. 11) to bring individual cutter blades of the bit body into the microwave radiation for preheating. Thus, by rotation and/or vertical translation, the cutters of the different blades may be preheated in sequence. Water jackets and/or other cooling devices may be used to prevent the threaded pin portion of the bit from overheating during the cutter brazing process.

Although the present disclosure and its advantages have been described in detail, it should be understood that various changes, substitutions and alternations can be made herein without departing from the spirit and scope of the disclosure as defined by the following claims.

What is claimed is:

1. A method of making a drill bit comprising:

placing matrix material in a bit body mold;

placing a metal blank in the bit body mold;

placing a binder material in the bit body mold with the binder material proximate the matrix material and the metal blank; and exposing the bit body mold and at least the binder material to microwave radiation to establish at least two temperature zones having different temperatures and heated via the microwave radiation to which each zone within the mold is exposed, wherein the binder material is exposed to microwave radiation focused on the binder material and away from the metal blank using a microwave wave guide, whereby binder material is heated to a selected temperature to allow binder material to melt and to infiltrate matrix material without overheating the metal blank.

2. A method of making a drill bit as claimed in claim 1, wherein the placing matrix material in a bit body mold comprises placing a matrix material selected from the group consisting of cemented carbides, spherical carbides, macrocrystalline tungsten carbide, and cast carbide in a bit body mold.

3. A method of making a drill bit as claimed in claim 1, wherein the placing matrix material in a bit body mold comprises: placing a first layer of a matrix material in the bit body mold prior to the placing a metal blank in the bit body mold; and placing a second layer of a matrix material in the bit body mold after the placing a metal blank in the bit body mold.

4. A method of making a drill bit as claimed in claim 1, wherein the placing a metal blank in the bit body mold comprises placing a blank pin in the bit body.

5. A method of making a drill bit as claimed in claim 1, wherein the placing a binder material in the bit body mold comprises a binder material selected from copper (Cu), nickel (Ni), cobalt (Co), iron (Fe), molybdenum (Mo) individually and alloys based on these metals.

6. A method of making a drill bit as claimed in claim 1, wherein the exposing binder material to microwave radiation comprises exposing binder material to microwave radiation having a frequency between 0.5 GHz and 10 GHz and a power output between 900 and 20,000 Watts.

7. A method of making a drill bit as claimed in claim 1, further comprising packing matrix material, whereby the density of matrix material is increased.

8. A method of making a drill bit as claimed in claim 1, further comprising placing a displacement material in the bit body mold.

9. A method of making a drill bit as claimed in claim 1, further comprising cooling the bit body mold and materials disposed therein to form a coherent matrix bit body securely engaged with the metal blank.

10. A method of making a drill bit as claimed in claim 1, further comprising moving the bit body mold relative to the microwave wave guide, whereby different parts of the bit body mold are exposed to microwave radiation.

11. A method of making a drill bit as claimed in claim 1, further comprising isotropic heating the bit body mold.

12. A method of making a drill bit as claimed in claim 1, further comprising placing flux on top of the binder material in the bit body mold.

13. A method of making a drill bit as claimed in claim 1, further comprising exposing the matrix material to microwave radiation.

14. A method of making a drill bit as claimed in claim 1, further comprising exposing a plurality of portions of material to microwave radiation via a plurality of microwave waveguides.

15. A method of making a drill bit comprising:

placing at least a first layer of a matrix material selected from the group consisting of cemented carbides, spherical carbides, macrocrystalline tungsten carbide, and cast carbide in a bit body mold;

placing a displacement core having a generally cylindrical configuration defined in part by an outside diameter in the bit body mold;

placing a metal blank in the bit body mold coaxial with and around the displacement core to form an annulus defined in part by an inside diameter of the metal blank and the outside diameter of the displacement core;

placing at least a second layer of a matrix material selected from the group consisting of cemented carbides, spherical carbides, macrocrystalline tungsten carbide, and cast carbide in the bit body mold, wherein the second layer of a matrix material fills the annulus between the displacement core and the metal blank;

placing a binder material in the bit body mold with the binder material proximate matrix material and the metal blank;

exposing the bit body mold and at least the binder material to microwave radiation to establish at least two temperature zones having different temperatures and heated via the microwave radiation to which each zone within the mold is exposed, wherein the binder material is exposed to microwave radiation focused on the binder material and away from the metal blank using a microwave wave guide, whereby the binder material is heated to a selected temperature to allow the binder material to melt and to infiltrate matrix material without overheating the metal blank; and cooling the mold and materials disposed therein to form a coherent matrix bit body securely engaged with the metal blank.

16. A method of making a drill bit as claimed in claim 15, wherein the exposing binder material to microwave radiation comprises exposing binder material to microwave radiation having a frequency between 0.5 GHz and 10 GHz and a power output between 900 and 20,000 Watts.

17. A method of making a drill bit as claimed in claim 15, further comprising moving the bit body mold relative to the microwave wave guide, whereby different parts of the bit body mold are exposed to microwave radiation.

18. A method of making a drill bit as claimed in claim 15, further comprising exposing a plurality of portions of material to microwave radiation via a plurality of microwave waveguides.

19. A method of making a drill bit as claimed in claim 1, wherein the exposing step requires approximately one hour.

20. A method of making a drill bit as claimed in claim 15, wherein the exposing step requires approximately one hour.

21. A method of making a drill bit as claimed in claim 1, further comprising cooling the mold and materials disposed therein to form a coherent matrix bit body securely engaged with the metal blank, wherein specific portions of the matrix bit body or mold are exposed to microwave radiation and heated during the cooling step.

22. A method of making a drill bit as claimed in claim 15, further comprising exposing specific portions of the matrix bit body or mold to microwave radiation and thereby heating the specific portions during the cooling step.

* * * * *